US006623303B2

(12) United States Patent
Syed et al.

(10) Patent No.: US 6,623,303 B2
(45) Date of Patent: Sep. 23, 2003

(54) CABLE SHIELD TERMINATION SYSTEM USING CLAMPS AND FERRULES

(75) Inventors: Farrukh S. Syed, McKinney, TX (US); Eric C. Peterson, McKinney, TX (US); Richard Schumacher, Dallas, TX (US); Brent Boudreaux, Highland Village, TX (US); J. Michael Andrewartha, Plano, TX (US); Martha G. Peterson, McKinney, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/945,069

(22) Filed: Aug. 31, 2001

(65) Prior Publication Data

US 2003/0045141 A1 Mar. 6, 2003

(51) Int. Cl.[7] ..... H01R 9/03
(52) U.S. Cl. ..... 439/610; 439/470
(58) Field of Search ..... 439/608, 607, 439/609, 610, 108, 92, 578, 362, 276, 204; 174/35 R, 92; 248/62; 285/179, 373

(56) References Cited

U.S. PATENT DOCUMENTS 3,999,830 A * 12/1976 Herrmann et al. ..... 339/136
5,752,855 A * 5/1998 Mehez et al. ..... 439/610
5,755,597 A * 5/1998 Panis et al. ..... 439/610
6,195,487 B1 * 2/2001 Anderson et al. ..... 385/101
6,327,143 B1 * 12/2001 Bonstrom et al. ..... 361/683

* cited by examiner

*Primary Examiner*—Alexander Gilman

(57) ABSTRACT

The invention provides EMI cable shield termination apparatus. The apparatus includes (a) a cable exit panel coupled to a first electronic system and (b) one or more clamps coupled to the exit panel. The exit panel serves as an interface for one or more cables coupled to the first electronic system; the clamps provide mechanical coupling, and EMI shielding, for the cables to that interface. The exit panel couples to electrical ground such as through connection to the chassis of the first electronic system. The clamps also couple to ground through connection with the exit panel. Preferably, one end of the cables attaches to the clamps, at the interface formed by the exit panel, and the other end of the cables attach to respective ferrules coupled to a second electronics system. Beneficially, the apparatus reduces EMI effects generated from the first electronic system and coupled into the second electronic system. In preferred aspects of the invention, the first and second electronic systems are computers; and each of the clamps forms at least one aperture ("clamp aperture") to affix to a cable coupled to the first electronic system. The invention facilitates configurable cable shield terminations to meet mechanical requirements of a given installation; that is, a single cable construction permits multiple optional clamp attachment locations to accommodate different separations of the attached equipment.

18 Claims, 8 Drawing Sheets

86
84
82
88
88A
88B
90
90'

CABLE SHIELD TERMINATION SYSTEM USING CLAMPS AND FERRULES

RELATED APPLICATIONS

This application is related to copending and cofiled applications for U.S. Letters Patent Ser. No. 09/944,537, filed Aug. 31, 2001 and entitled SHIELDED CABLE SYSTEM FOR HIGH SPEED CABLE TERMINATION and Ser. No. 09/943,924, filed Aug. 31, 2001 and entitled CLAMP SYSTEM FOR HIGH SPEED CABLE TERMINATION.

BACKGROUND OF THE INVENTION

Complicated electronic systems often include multiple equipment cabinets or computers. A multitude of cables typically couple between these computers to provide high-speed data transfers, clocking, and other functions. Unfortunately, these cables also relay electromagnetic interference (EMI) into the surrounding environment. The computers, equipment and cabling must therefore be properly shielded against EMI to prevent unwanted coupling of noise from one computer to another, to prevent radiation of EMI into the environment, and to reduce susceptibility of the equipment to EMI from external sources.

Common solutions to EMI shielding include the shortening of cable length and the utilization of grounded metal coverings (e.g., a coaxial cable). Electrical designers also attempt to eliminate EMI from the source, often by attached capacitors and other components; however, this approach is not often practical unless the designers also manufacture the source of EMI.

As electronic systems increase in speed and complexity, the difficulties associated with EMI shielding similarly increase. There is therefore the need to improve EMI shielding within electronic systems. In particular, there is the need to improve EMI shielding between connected computers and/or equipment cabinets of such systems. The objects of the invention serve to address these needs. Other objects of the invention are apparent within the description that follows.

SUMMARY OF THE INVENTION

The invention in one aspect provides an EMI cable shield termination apparatus. The apparatus includes (a) a cable exit panel coupled to a first electronic system and (b) one or more clamps coupled to the exit panel. The exit panel serves as an interface for one or more cables coupled to the first electronic system; the clamps provide mechanical coupling, and EMI shielding, for the cables to that interface. The exit panel couples to electrical ground such as through connection to the chassis of the first electronic system. The clamps also couple to ground through connection with the exit panel. Preferably, one end of the cables attaches to the clamps, at the interface formed by the exit panel, and the other end of the cables attach to respective ferrules coupled to a second electronics system. In preferred aspects of the invention, the first and second electronic systems are computers; and each of the clamps forms at least one aperture ("clamp aperture") to affix to a cable coupled to the first electronic system.

In one aspect, the ferrules attach to chassis ground of the second electronics system. Accordingly, the ferrules function similarly to the clamps attached to chassis ground within the first electronics system. Beneficially, the apparatus of the invention reduces or inhibits EMI effects (e.g., noise) generated from the first electronic system and coupled into the second electronic system.

In the preferred aspect, each of the clamps is formed of two parts; the two parts couple together with one or more screws. The two parts also form at least one clamp aperture when joined together. When in use, the clamp aperture grips a cable in a "clamshell" configuration, known in the art, when the clamp screws are tightened in connecting the two parts. Preferably, the clamps are made from nickel plated aluminum, though those skilled in the art should appreciate that other conductive metals, with or without corrosion-resistant coatings, may be used without departing from the scope of the invention.

In one aspect, one or more of the clamps forms first and second apertures for interfacing with first and second cables of a cable pair; the first cable being affixed within the first aperture, the second cable being affixed within the second aperture. Clamps may have additional or fewer apertures as a matter of design choice.

In another aspect, the apparatus has an array of "N" clamps supporting (a) up to N cables or (b) up to N cable pairs. If any clamp aperture is not used, the apparatus preferably includes a blank EMI plug, integrated with the aperture, to inhibit EMI noise therethrough. Preferably, any vacant clamp aperture is sealed with a blank EMI plug.

In yet another aspect, the clamps have one or more ribs for enhancing contact and retention to cables and/or blank plugs coupled to clamp apertures.

In still another aspect, one or more of the cables of the apparatus include a hard point contact circumferentially protecting the cable from structural damage at the clamp aperture.

The invention is next described further in connection with preferred embodiments, and it will become apparent that various additions, subtractions, and modifications can be made by those skilled in the art without departing from the scope of the invention.

BRIEF DESCRIPTION OF THE EMBODIMENTS

A more complete understanding of the invention may be obtained by reference to the drawings, in which.

Figures 8, 8A, 8B:
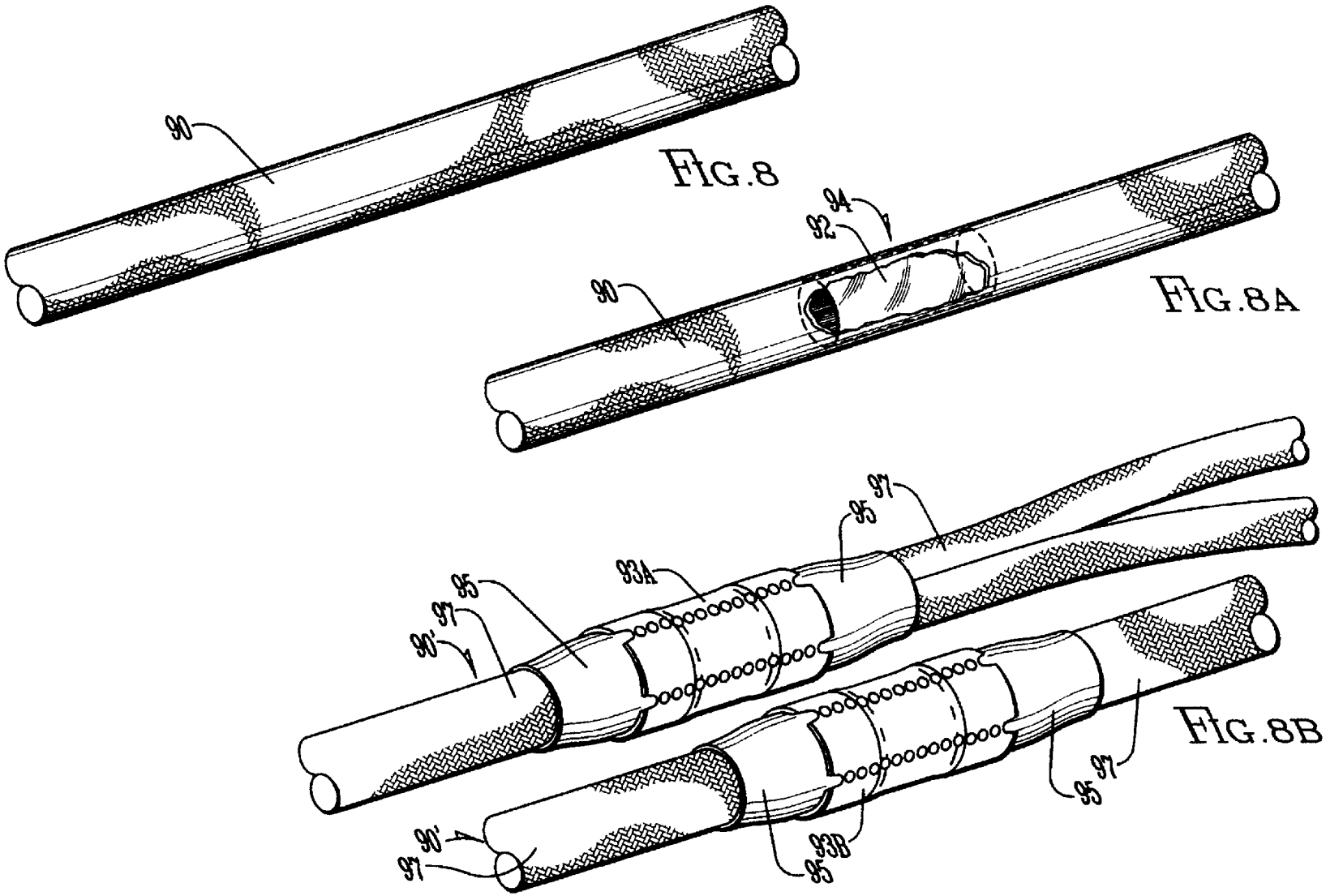
FIG. 8 shows a representative cable for use with the invention.
Figure 6:
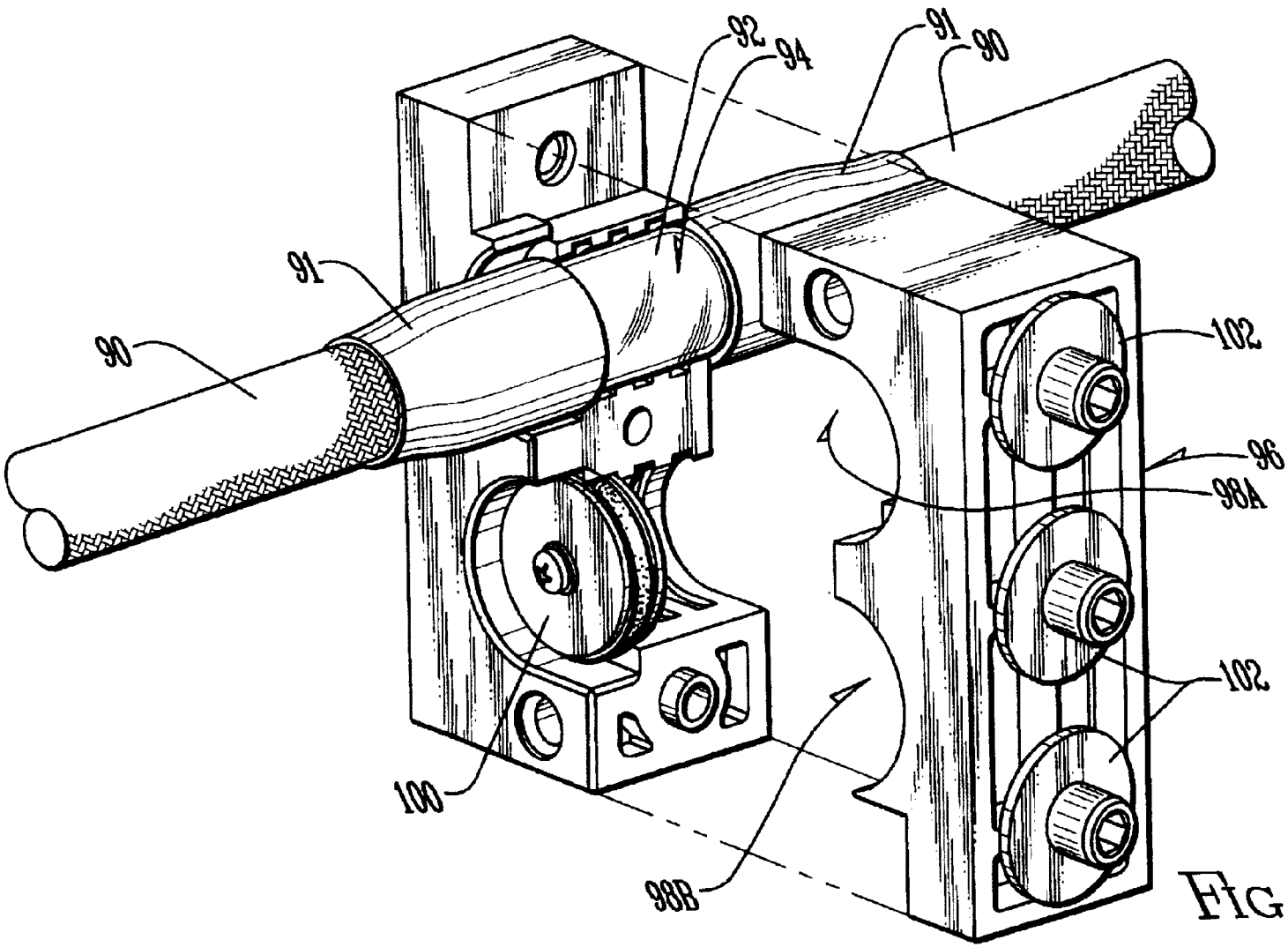
Figure 11:
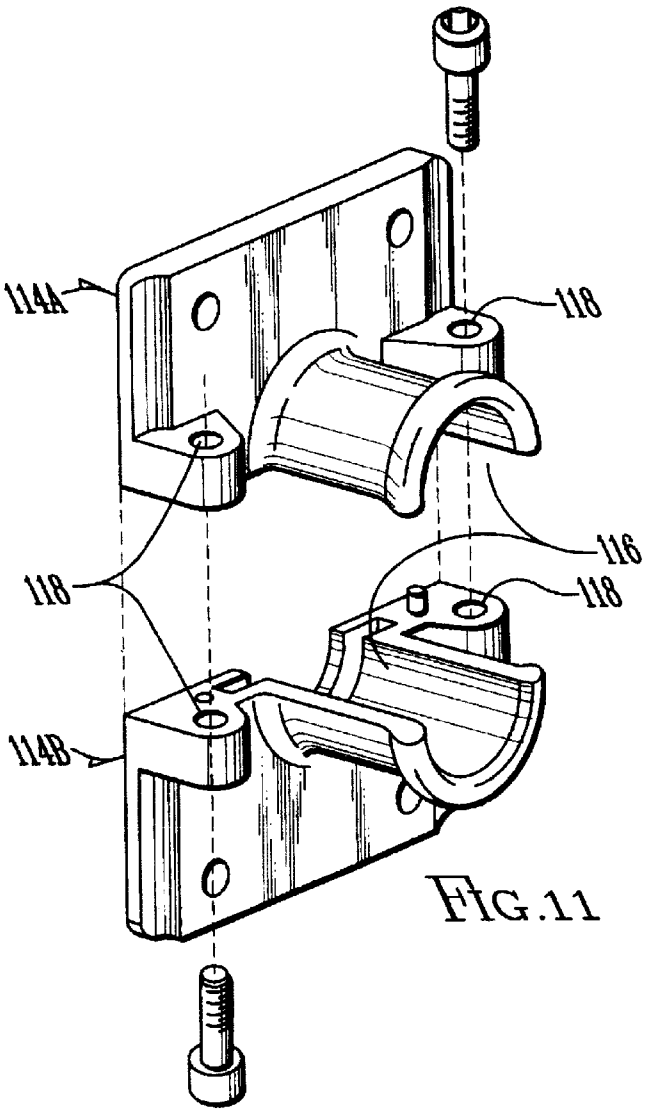
Figure 10:
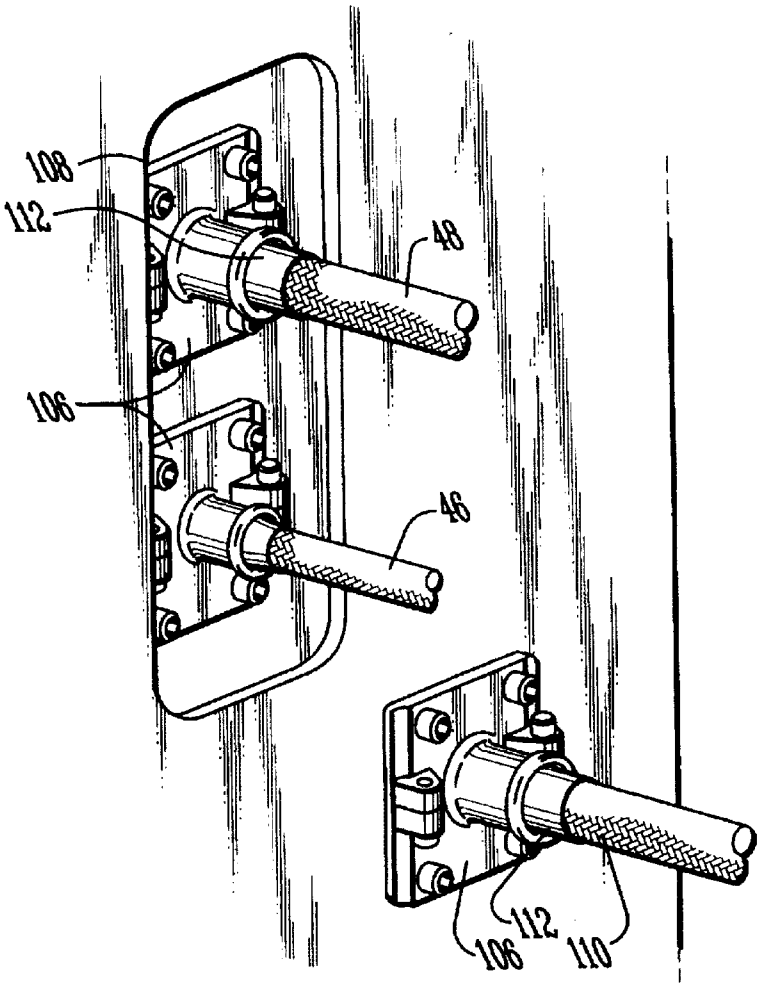
Figure 12:
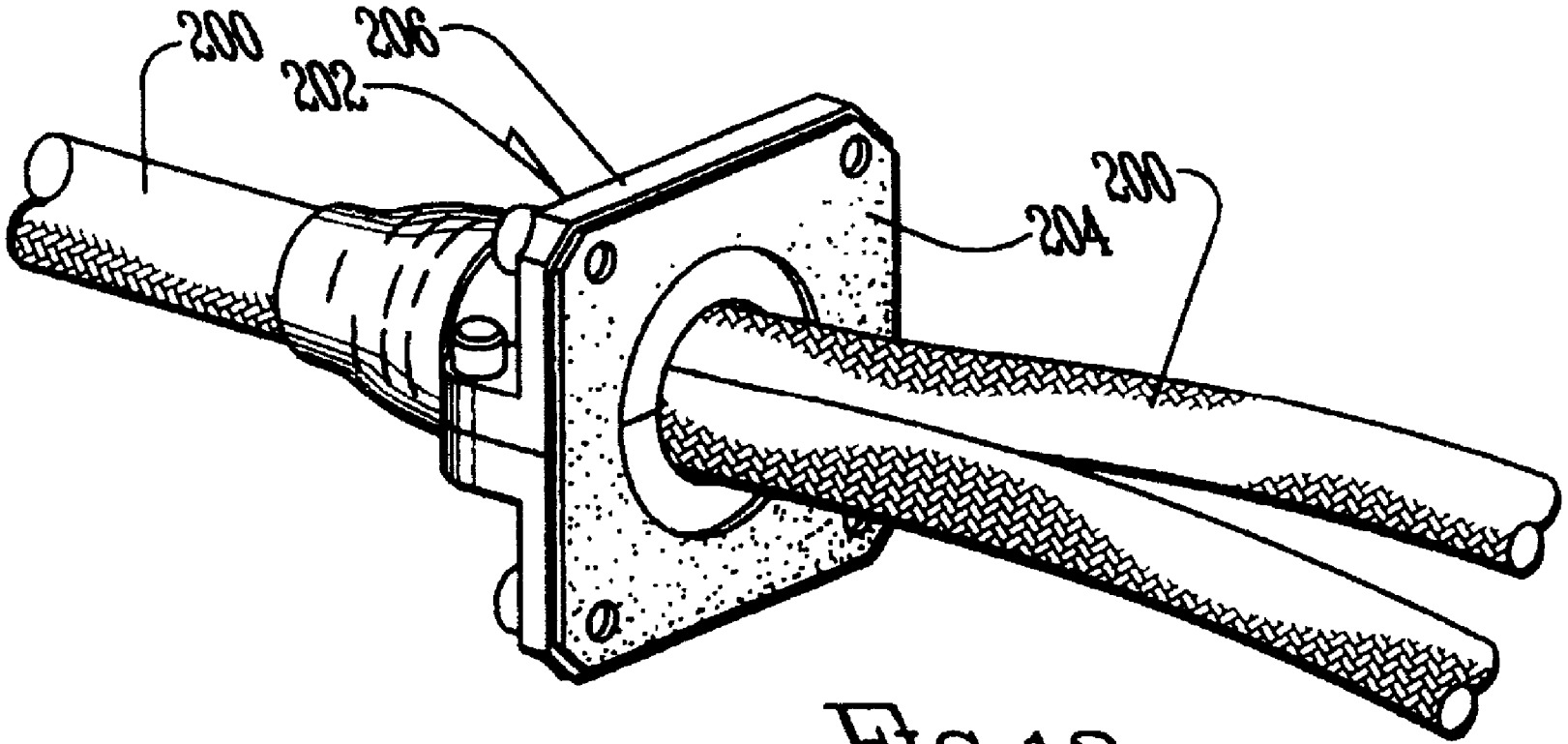

FIG. 8A shoes the cable of FIG. 8 opened up to reveal an internal hard sleeve to protect mechanical integrity of wiring within the cable;

FIG. 8B illustrates tear away covers over hard sleeves in representative cabling of the invention;

FIG. 9 shows the cable of FIG. 8 integrated with a clamp of the invention;

FIG. 10 illustrates operational terminations for cabling to module ferrules of a computer, in accord with the invention;

FIG. 11 shows further details of a ferrule suitable for use with the invention; and FIG. 12 shows a perspective view of one ferrule clamped about a cable in accord with the invention.

DETAILED DESCRIPTION OF THE DRAWINGS

Figure 1:
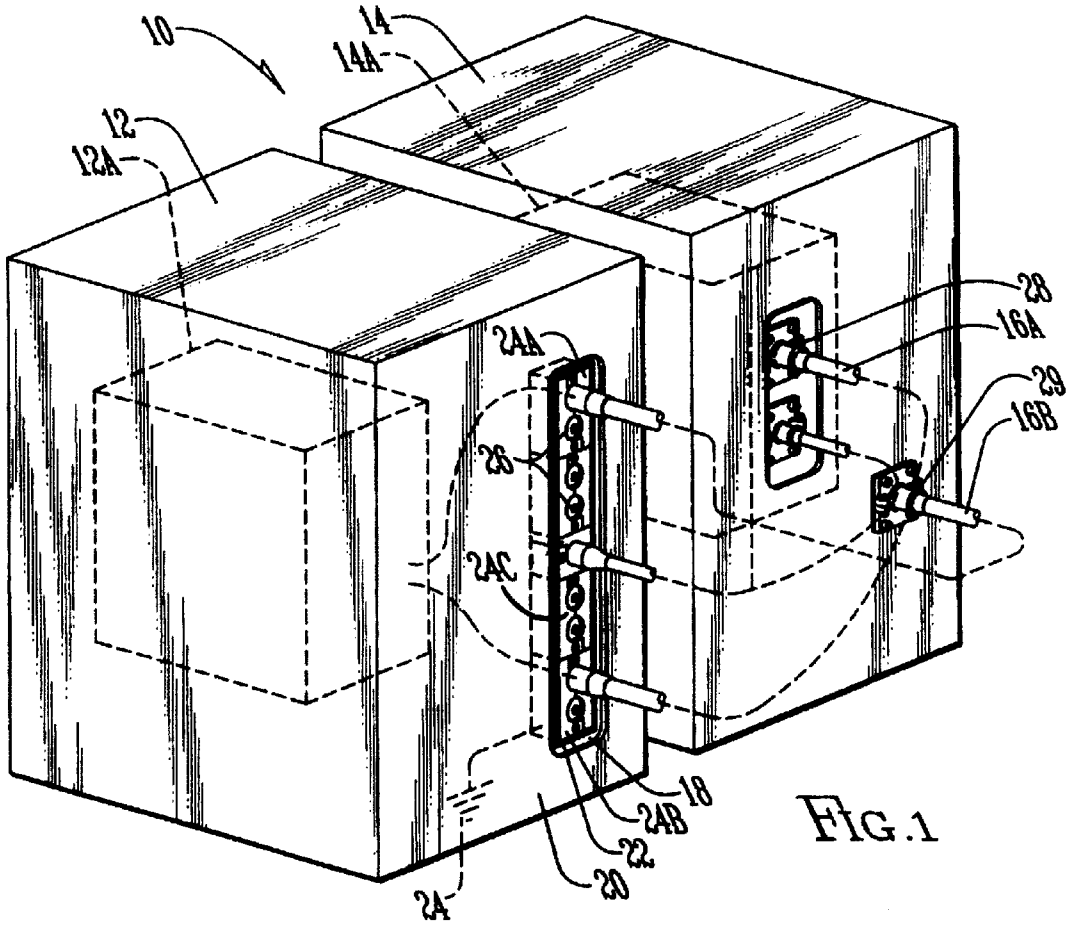
FIG. 1 shows a schematic block diagram of one electronic system architecture utilizing cable shield termination apparatus of the invention and between two internal computers.

FIG. 1 shows an electronic system 10 with two internal computers 12, 14. Computers 12, 14 have internal modules 12*a*, 14*a*, respectively, to perform certain functions therein. Computers 12, 14, and/or modules 12*a*, 14*a*, communicate between each other by cables 16*a*, 16*b*. By way of example, cable 16*a* may be a high-speed data cable and cable 16*b* may be a clocking cable. System 10 is shown illustratively with two computers 12, 14, two modules 12*a*, 14*a*, and two cables 16*a*, 16*b*; those skilled in the art should appreciate that additional computers, modules and cables, and associated components described below, may be included within system 10 without departing from the scope of the invention. As used herein, a "computer" such as computer 12 or 14 is representative of "electronic equipment" suitable for use with the invention; accordingly the term "computer" used herein should be considered to include electronic equipment that attach with like equipment in inhibiting EMI noise radiated or conducted into or out of either equipment.

Figure 2:
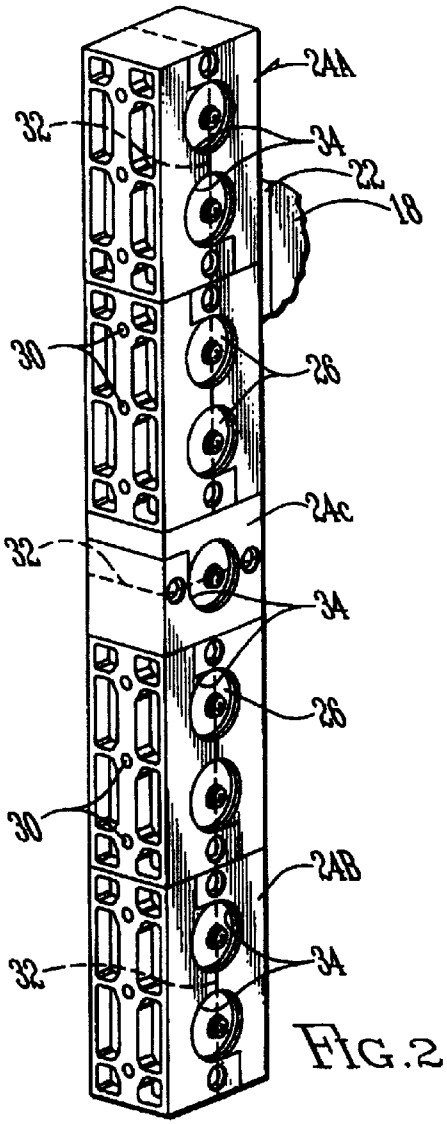
FIG. 2 illustrates a front view of the clamp array of the apparatus of FIG. 1.

Cables 16*a*, 16*b* extend through the cable exit panel 18 forming an interface integral with the housing 20 of computer 12. Preferably, EMI shielding 22 seals panel 18 to housing 20; and panel 18 couples to chassis ground 24, as shown. Two clamps 24*a*, 24*b* couple with exit panel 18 to affix cabling 16*a*, 16*b* to exit panel 18. Additional clamps 24*c* may couple with panel 18 to accommodate additional cabling. When unused, clamps 24*c* preferably incorporate one or more EMI plugs 26 (shown illustratively in FIG. 1) to seal off the cable pathway from EMI noise, as described in more detail below. Though not required, clamps 24 usually are contiguous to form an array of clamps 24, as shown in FIG. 2. Clamps 24 may also have different sizes and one or more apertures for cabling, also as shown in FIG. 2.

Cable 16*a* terminates at a ferrule 28 coupled with module 14*a* of computer 14. Cable 16*b* terminates at a ferrule 29 coupled with computer 14. A mechanical description of suitable ferrules such as ferrule 28, 29 is described in more detail below in connection with FIG. 10 and FIG. 11.

The configuration formed by exit panel 18, clamps 24, cables 16 and ferrules 28, 29 serve to reduce or eliminate EMI noise generated in computer 12 and coupled into computer 14. The configuration facilitates the use of high-speed cabling with electromagnetic compatibility. The configuration further provides individual containment for each cable 16 from electromagnetic interference, thereby simplifying mitigation of EMI sources. The configuration is also scaleable to facilitate field upgrades. Further, the configuration simplifies cable management between computers 12, 14, and also provides cable strain relief at the interface formed by the cable exit panel 18.

FIG. 2 shows a front view of cable exit panel 18 and clamps 24*a*, 24*b*, 24*c*. Although five clamps 24 are shown, more or fewer clamps may be incorporated with panel 18 without departing from the scope of the invention. Clamps 24 preferably operate to affix cabling with a "clamshell" mechanism, as described in more detail below. Accordingly, clamps 24 are preferably formed of two parts coupled together by screws 30. The two parts are illustratively shown in FIG. 2 by dotted lines 32. As shown, the direction of line 32—horizontal or vertical—is a matter of design choice. Clamps 24 may form one or more cable apertures 34, as shown.

Figure 3A:
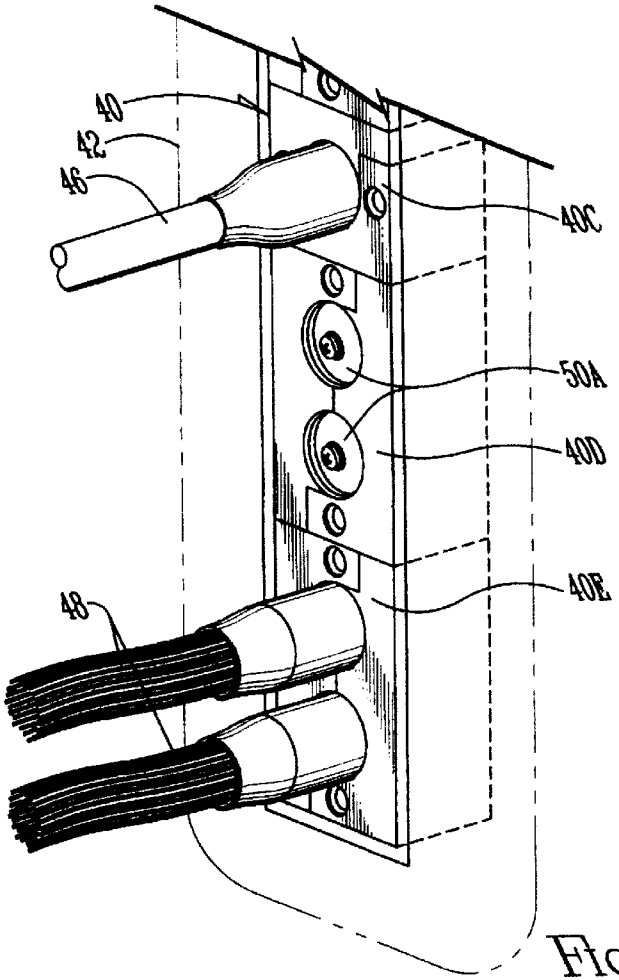
FIG. 3A illustrates the clamp array and cable exit panel of FIG. 2 as viewed from within the associated computer.
Figure 3:
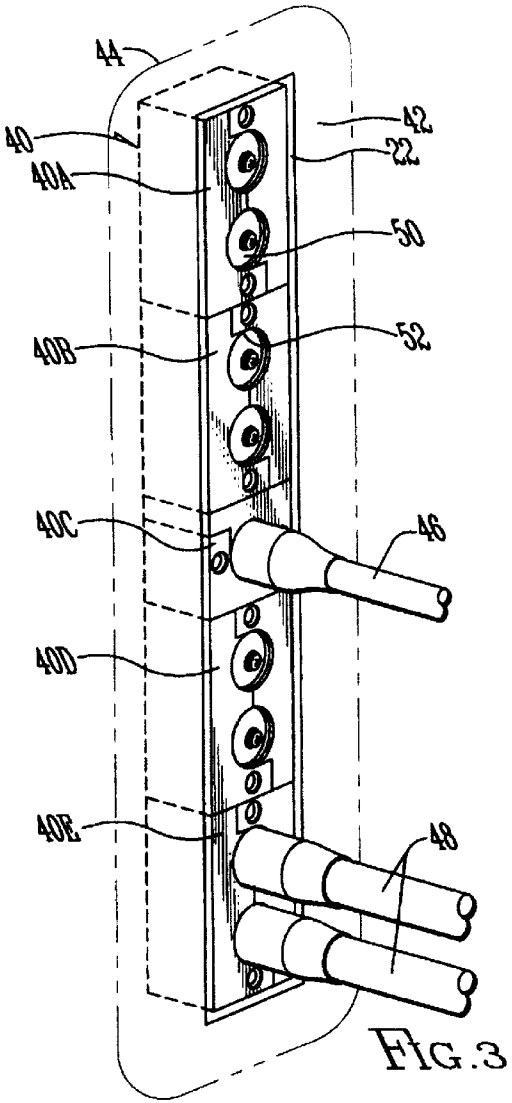
FIG. 3 shows a representative clamp array in use to affix cabling to the cable exit panel, in accord with the invention.

FIG. 3 shows an operational clamp array 40 constructed according to the invention and including five individual clamps 40A, 40B, 40C, 40D, and 40E. Clamps 40 couple to a cable exit panel 42, illustratively shown through a cut-away computer housing 44. Panel 42 may for example slide in from the rear of the associated computer; panel 42 may couple to either side of housing 44 for the computer, symmetrically, as a matter of design choice. Clamp 40C is smaller than other clamps 40A, 40B, 40D, 40E as a matter of design choice; clamp 40C is also illustratively shown affixed to a clocking cable 46. Clamp 40E is illustratively shown affixed to a high-speed cable pair 48. As described below, array 40 preferably includes EMI plugs 50 within any unused cable aperture 52.

FIG. 3A illustrates clamps 40 and cable exit panel 42 from a view within the computer shielded by panel and clamps 42, 40. For example, the view of FIG. 3A is similar to a view of panel and clamps 18, 24 from within computer 12. FIG. 3A further illustrates a back plug 50A of the associated EMI plug 50 of FIG. 3.

FIG. 3 and FIG. 3A together illustrate how cabling couples to clamps at the cable exit panel interface to seal EMI generated from within the computer (e.g., computer 12, FIG. 1).

Figure 5:
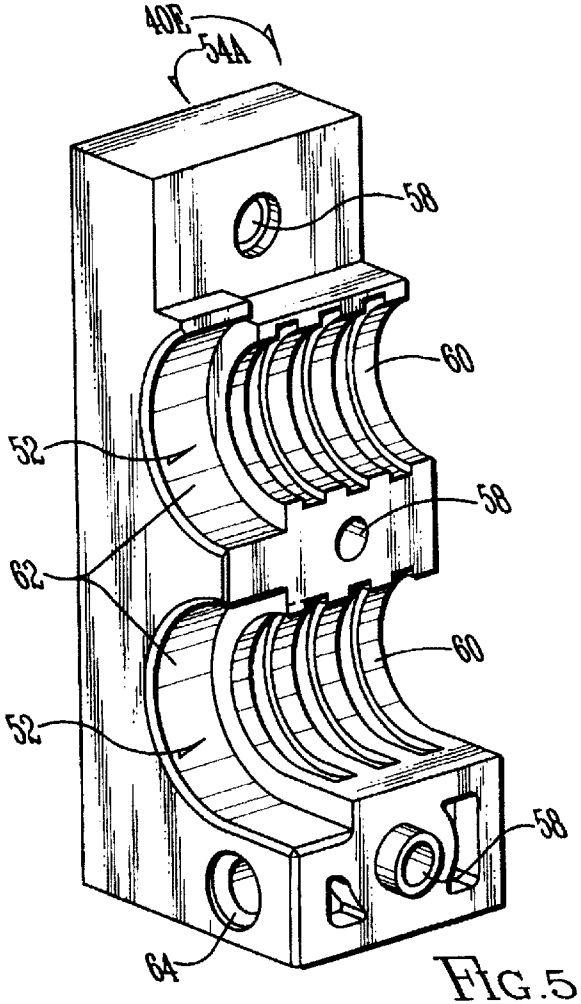
FIG. 5 shows additional detail of the clamp of FIG. 4.
Figure 4:
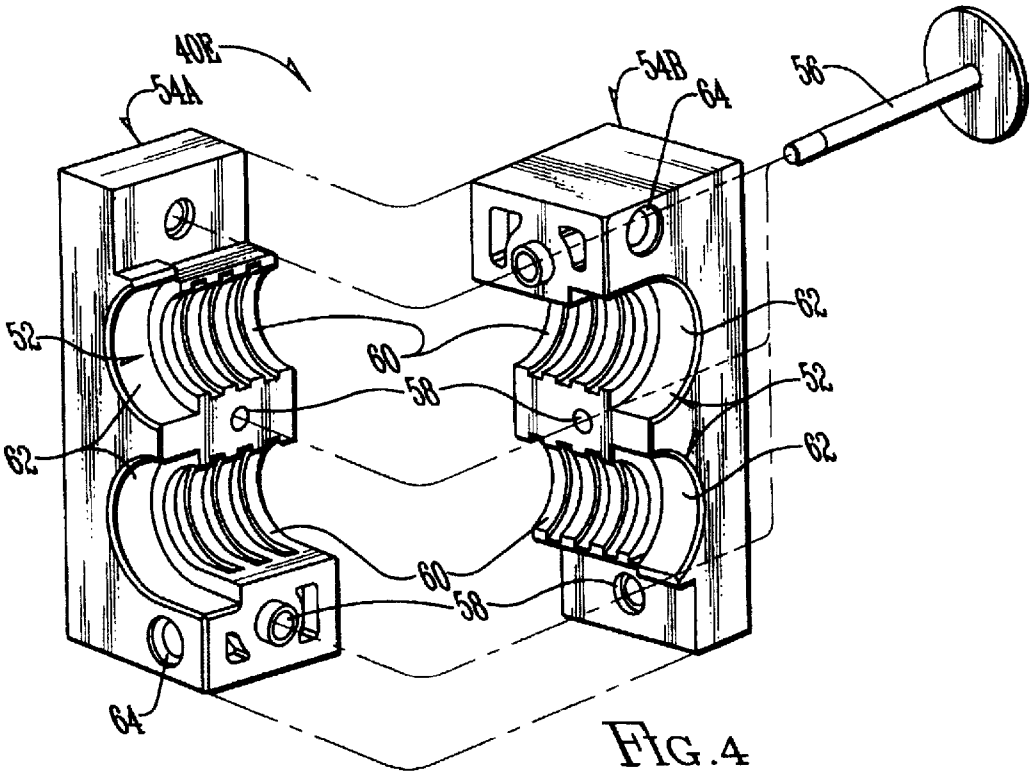
FIG. 4 shows a perspective view of one of the clamps of FIG. 3.

FIG. 4 shows clamp 40E in a perspective view and in an open position. When closed, clamp 40E forms two apertures (e.g., to attach to cable pair 48) when the two parts 54A, 54B of clamp 40E are joined together by clamp screws 56 within screw receptacles 58. Preferably, though not required, each aperture of clamp 40E includes one or more ribs 60 to enhance gripping to cabling 48. Each aperture also preferably includes an EMI plug seat 62 for an EMI plug (shown in more detail in FIG. 7 and FIG. 8). Preferably, clamp 40E couples to the cable exit panel (e.g., panel 18, FIG. 1) by one or more screws, through screw apertures 64. FIG. 5 further illustrates features of clamp 40E.

Figure 7:
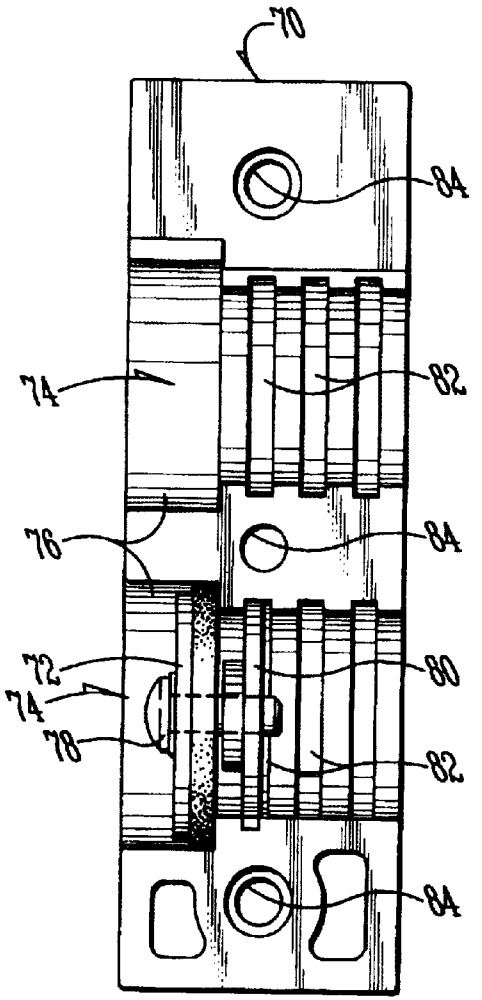
FIG. 6 and FIG. 7 illustrate coupling of an EMI plug within a clamp aperture, in accord with the invention.
Figure 6:
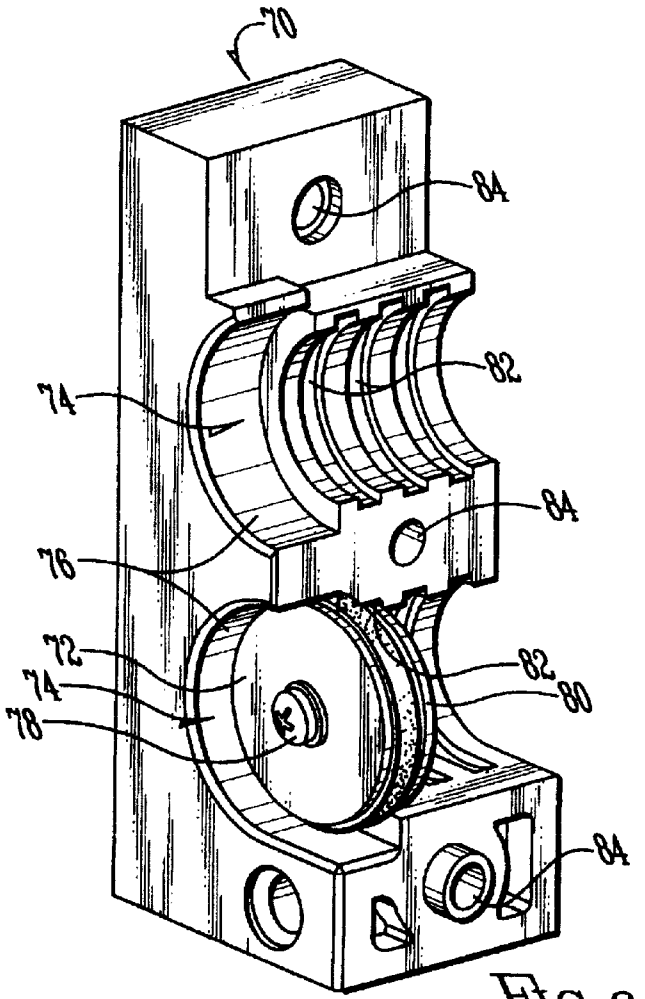

In a perspective view, FIG. 6 illustrates one half of a clamp 70 of the invention and incorporating an EMI plug 72. Plug 72 is used within the aperture 74 of clamp 70 when, for example, aperture 74 is not affixed to cabling between computers 12, 14 (FIG. 1). FIG. 7 shows further detail of clamp 70 and plug 72 in a front view. Plug 72 is seated to EMI plug seat 76; and plug 72 is affixed to clamp 70 by a screw 78 coupled to a back plug 80. Back plug 80 seats within one of the ribs 82 of aperture 74. FIG. 6 and FIG. 7 also illustrate screw receptacles 84 for coupling to the other half of clamp 70 (not shown).

FIG. 8 shows one representative cable 90 suitable for use with the invention. In the preferred embodiment, a hard sleeve surrounds wires within cable 90 at the location 94 where cable 90 interfaces with the clamp, such as shown in FIG. 9. FIG. 8A shows cable 90 opened up to illustrate the hard sleeve 92. Hard sleeve 92 protects the mechanical integrity of wires within cable 90 when clamped within its clamp 96. Clamp 96 is shown with two apertures 98A, 98B; aperture 98B is shown sealed with an EMI plug 100. Cable 90 is clamped within aperture 98A when clamp screws 102 are tightened. In the preferred embodiment, cable 90 has a tear-away cover over the hard sleeve area that may be selectively removed as desired from cable 90 and prior to clamping within a clamp. FIG. 8B illustrates two such cables 90' and respective tear away covers 93A, 93B. A non-conductive jacket 97 covers the conductive cable braid to protect braid (not shown) from abrasion and the jacket 97 is terminated with sleeving 95 in multiple locations.

Preferably, there are two tear away covers 93 on each cable 90, 90'. The tear away cover is removed to expose the hard sleeve (item 92, FIG. 8A) where it is gripped by a clamp (e.g., within clamp 96, FIG. 9). In order to accommodate different computer configurations, two or more tear away covers and hard sleeves may be incorporated within a single cable; this is particularly useful when different lengths are desired within the first computer (e.g., computer 12, FIG. 1).

As shown in FIG. 1, cables 16 extend from computer 12, through clamps and panel 24, 18, respectively, and terminate at computer 14 or module 14A. FIG. 10 illustrates cable terminations 106 with a module 108 such as module 14A. Specifically, FIG. 10 illustrates terminations 106 of the other end of cables 46, 48 shown in FIG. 3 and FIG. 3A, and an additional cable 110. Each termination 106 includes a ferrule 112. Ferrules 112 operate similarly to the clamps at the other end of cables 46, 48, 110; they preferably couple to chassis ground of module 108 to provide beneficial EMI shielding.

Each ferrule may for example be constructed as ferrule 114 of FIG. 11 and made from conductive material (e.g., nickel plated zinc die casting). More particularly, ferrule 114 may be constructed from two parts 114A, 114B that enclose about a cable along a cable pathway 116. Parts 114A, 114B may be coupled together by screws through receptacles 118.

FIG. 12 illustrates a cable 200 mounted within a ferrule 202, in accord with the invention. Ferrule 202 operates similarly to the clamps 24 of FIG. 1 to beneficially seal against EMI noises. FIG. 12 also shows a conductive elastomer pad 204 on the mounting surface 206 of ferrule 202, to provide better conductive connection to the underlying electronics module.

The invention thus attains the objects set forth above, among those apparent from the preceding description. Since certain changes may be made in the above methods and systems without departing from the scope of the invention, it is intended that all matter contained in the above description or shown in the accompanying drawing be interpreted as illustrative and not in a limiting sense. It is also to be understood that the following claims are to cover all generic and specific features of the invention described herein, and all statements of the scope of the invention which, as a matter of language, might be said to fall there between.

Having described the invention, what is claimed is:

1. A cable termination system for inhibiting EMI noise between first and second computers, comprising:

a cable exit panel coupled to a housing and ground of the first computer;

a cable extending from the first computer to the second computer and through the cable exit panel;

a clamp coupled with the cable for support thereof, the clamp being formed in opposed separable parts that couple with one another to form a rectilinear block defining at least one aperture permitting passage of the cable through the clamp, the rectiliner block presenting an axis substantially parallel with the cable and two axes perpendicular to the cable, the separable parts being asymmetrical with respect to one another along the two axes perpendicular to the cable, mounting structure operable for mounting the clamp on the cable exit panel and grounding the clamp to the cable exit panel, circumscribing an opening through which the cable passes when the clamp is mounted, the clamp and the mounting structure cooperatively inhibiting EMI noise.

2. A system of claim 1, wherein the clamps provide strain relief for connections of the cables to modules within the first computer.

3. A system of claim 1, further comprising one or more screws for coupling the two parts together.

4. A system of claim 1, wherein the exit panel is constructed from galvanized steel.

5. A system of claim 1, wherein at least one of the clamps is constructed with nickel plated steel.

6. A system of claim 1, further comprising an EMI shield for sealing the panel to the housing.

7. A system of claim 6, wherein the shield comprises a mechanically-compliant electrically conductive seal.

8. A system of claim 1, wherein at least one of the cables comprises a first hard sleeve for protecting mechanical integrity of the cable when affixed within one of the clamps.

9. A system of claim 8, wherein the one cable comprises multiple tear away covers that are at least partially removable to expose clamping points with the first hard point sleeve.

10. A system of claim 1, further comprising one or more ferrules for coupling the cables to ground at the second computer.

11. A system of claim 10, wherein each of the ferrules comprise two parts constructed and arranged to clamp about at least one cable.

12. A system of claim 10, wherein at least one of the ferrules is constructed with nickel plated zinc die casting.

13. A system of claim 1, wherein each of the clamps forms at least one cable aperture for affixing to one of the cables.

14. A system of claim 13, wherein each cable aperture comprises one or more ribs to facilitate gripping to one of the cables.

15. A system of claim 13, further comprising at least one EMI plug for sealing a cable aperture that is not affixed to one of the cables.

16. A system of claim 15, further comprising a back plug, coupled within the aperture, and a screw for affixing the EMI plug to the back plug, wherein the EMI plug immovably couples with the clamp as a seal against EMI noise.

17. A method for shielding EMI noise between first and second computers connected by electronic cabling there between, comprising the steps of:

terminating one end of the cables at the second computer with one or more grounded ferrules;

passing the cables through a cable exit panel interface of the first computer, and clamping the cables to the cable panel interface of the first computer through one or more grounded clamps to form a cooperative EMI seal between the cable exit panel interface and the one or more clamps, where the clamping step includes forming a rectilinear block as an union between opposed separable parts that couple with one another to define at least one aperture permitting passage of the cable through the clamp, the rectiliner block presenting one axis substantially parallel with the cable and two axes perpendicular to the cable, the separable parts being asymmetrical with respect to one another along the two axes perpendicular to the cable to form the separable block.

18. In an electronic architecture of the type having at least first and second internal electronic systems coupled together by one or more data cables, the improvement comprising:

a cable exit panel coupled to ground and the first internal electronic system, the cables passing through the cable exit panel; and one or more clamps coupled and grounded to the cable exit panel, for affixing the cables through the cable exit panel the one or more clamps each being formed in opposed separable parts that couple with one another to form a rectilinear block defining at least one aperture permitting passage of the cable through the clamp, the rectiliner block presenting one axis substantially parallel with the cable and two axes perpendicular to the cable, the separable parts being asymmetrical with respect to one another along the two axes perpendicular to the cable, the one or more clamps and the cable exit panel cooperatively inhibiting EMI noise generated by the first electronic system and coupled through the cables from the first electronic system to the second electronic system.

* * * * *